US008956066B2

(12) United States Patent
Young et al.

(10) Patent No.: US 8,956,066 B2
(45) Date of Patent: Feb. 17, 2015

(54) ROLLER-BALL APPLICATOR ASSEMBLY WITH RETAINER FOR TOPICAL OILS APPLICATION

(75) Inventors: D. Gary Young, Alpine, UT (US); Son Q. Le, Orem, UT (US); Marc Schreuder, Provo, UT (US); Cole Woolley, Orem, UT (US)

(73) Assignee: Young Living Essential Oils, LC, Lehi, UT (US)

( * ) Notice: Subject to any disclaimer, the term of this patent is extended or adjusted under 35 U.S.C. 154(b) by 0 days.

(21) Appl. No.: 13/425,072

(22) Filed: Mar. 20, 2012

(65) Prior Publication Data

US 2013/0251440 A1 Sep. 26, 2013

Related U.S. Application Data

(63) Continuation-in-part of application No. 13/231,916, filed on Sep. 13, 2011.

(51) Int. Cl.
*B43K 7/10* (2006.01)

(52) U.S. Cl.
USPC ..... 401/216; 401/209; 401/213

(58) Field of Classification Search
USPC ..... 401/213, 216, 209
See application file for complete search history.

(56) References Cited

U.S. PATENT DOCUMENTS

| | | | | |
|---|---|---|---|---|
| 2,923,957 | A | 2/1960 | Gentile | |
| 2,937,392 | A * | 5/1960 | Williams | 401/213 |
| 3,036,328 | A * | 5/1962 | Schaich | 401/213 |
| 3,048,881 | A * | 8/1962 | Ackerman | 401/216 |
| 4,270,526 | A * | 6/1981 | Morales et al. | 401/21 |
| 4,571,106 | A * | 2/1986 | Scuderi | 401/209 |
| 5,131,384 | A * | 7/1992 | Obagi | 401/28 |
| 5,553,957 | A | 9/1996 | Dornbusch et al. | |
| 7,117,818 | B2 | 10/2006 | Pappas et al. | |
| 7,293,930 | B2 | 11/2007 | Chuang | |
| 7,311,462 | B2 | 12/2007 | Kervoalen | |
| 7,674,061 | B2 | 3/2010 | Baines et al. | |
| 2005/0249540 | A1 | 11/2005 | Gueret | |
| 2006/0018702 | A1 | 1/2006 | Silva | |
| 2006/0018704 | A1 * | 1/2006 | Baines et al. | 401/213 |
| 2006/0222445 | A1 * | 10/2006 | Chuang | 401/216 |
| 2006/0287616 | A1 | 12/2006 | Nan | |
| 2008/0121751 | A1 * | 5/2008 | Steinhagen et al. | 242/588.6 |

FOREIGN PATENT DOCUMENTS

| | | |
|---|---|---|
| KR | 200228675 | 8/2001 |
| KR | 2000228675 | 8/2001 |

(Continued)

OTHER PUBLICATIONS

PCT/US2012/029943, International Search Report, Feb. 28, 2013.

(Continued)

*Primary Examiner* — David Walczak
*Assistant Examiner* — Bradley Oliver
(74) *Attorney, Agent, or Firm* — Kunzler Law Group, PC

(57) ABSTRACT

Exemplary applicator devices for applying topical oils to an individual are disclosed. Some embodiments of an exemplary applicator device may include a topical oil container and a roller-ball applicator coupled to the container. The roller-ball applicator may include a roller-ball housing, a roller-ball within the housing, the roller-ball being freely rotatable within the housing, and a retention cap configured to retain the roller-ball within the housing.

21 Claims, 4 Drawing Sheets

(56) References Cited

FOREIGN PATENT DOCUMENTS

| | | |
|---|---|---|
| WO | 00/70995 | 11/2000 |
| WO | 2011003211 | 1/2011 |

OTHER PUBLICATIONS

PCT/US2012/020207, International Preliminary Report on Patentability, Mar. 18, 2014.
PCT/US2012/020207, International Search Report, Sep. 27, 2012.
PCT/US2012/020207, Written Opinion, Sep. 27, 2012.
U.S. Appl. No. 13/231,916, Notice of Allowance, May 15, 2014.
U.S. Appl. No. 13/231,916, Final Office Action, Feb. 14, 2014.
U.S. Appl. No. 13/231,916, Office Action, Jul. 14, 2014.
Application No. PCT/US2012/029943, International Preliminary Report on Patentability, Oct. 2, 2014.

* cited by examiner

ROLLER-BALL APPLICATOR ASSEMBLY WITH RETAINER FOR TOPICAL OILS APPLICATION

This application is a continuation-in-part of U.S. patent application Ser. No. 13/231,916 filed Sep. 13, 2011.

FIELD

This application relates generally to roller ball applicators. In particular, this application relates to roller ball applicators for applying topical oils to an individual.

BACKGROUND

In recent years, sales for essential oils and other topically applied oils have exploded. Topically applied oils are usually oils which are derived from, or include certain essential components or essences of different substances. Such topically applied oils are generally referred to as essential oils.

Essential oils, known as nature's living energy, are the natural, aromatic volatile liquids found in shrubs, flowers, trees, resins, fruit peels, rhizomes, roots, bushes, and seeds. The distinctive components in essential oils defend plants against insects, environmental conditions, and disease. They are also vital for a plant to grow, live, evolve, and adapt to its surroundings. Essential oils are extracted from aromatic plant sources via steam distillation, cold pressing, and other types of distillation. Essential oils are highly concentrated and far more potent than dry herbs. Other topically applied, oils and fatty oils may include olive oil, almond oil, coconut oil, etc., and oils high in esters, such as jojoba oil, and waxes such as beeswax.

While essential oils often have a pleasant aroma, their phytochemical makeup is complex and their benefits vast—which makes them much more than something that simply smells good. Historically, essential oils have played a prominent role in everyday life. With more than 200 references to aromatics, incense, and ointments throughout the Bible, essential oils are said to be used for anointing and healing the sick. Today, essential oils are used for aromatherapy, massage therapy, emotional health, personal care, nutritional supplements, household solutions, and much more.

Roller-ball applicators have been used in many applications. However, roller-ball applicators generally use a fairly pliable plastic housing to accommodate the ball in a press-fit assembly. Traditional roller-ball assemblies are unsuitable for use with most topical oils, such as essential oils, particularly citrus essential oils (i.e., lemon, orange, grapefruit, bitter orange, yuzu, lime, bergamot, etc.), frankincense, high terpene oils, and other similar oils with potent chemical solvents, because the oils tend to impregnate plastics and relax the elasticity or swell the plastic, which often causes the roller-ball to become excessively loose and potentially dislodge, or swell the roller-ball and generally make plastic containers unsuitable. Additionally, essential oils tend to work as solvents with plastics and can leach unwanted chemicals and compounds from the plastics into the essential oils. Because of this, applicators for topical oils use different application methods and devices that do not require plastics that retain their material properties, and when using essential oils, generally avoid plastics altogether.

SUMMARY

Exemplary applicator devices for applying topical oils to an individual are disclosed herein. Some embodiments of an exemplary applicator device may include a topical oil container and a roller-ball applicator coupled to the container. The roller-ball applicator may include a roller-ball housing, a roller-ball within the housing, the roller-ball being freely rotatable within the housing, and a retention cap configured to retain the roller-ball within the housing. In some embodiments, an applicator device may include a cap configured to be removably attached to the container and to seal topical oil within the topical oil container when the cap is securely attached to the container.

In some embodiments, the topical oil may comprise an essential oil. The retention cap may also be formed from metal, such as aluminum, aluminum alloys, and/or anodized aluminum. Exemplary devices may be configured to provide access to at least a volume of 0.3 ml for each application. The roller-ball may be formed from metal or glass and the roller-ball may include surface features. Similarly, the topical oil container may be formed from glass.

Some exemplary methods for applying topical oil to an individual may include: placing topical oil in a container; coupling a roller-ball assembly to the container, the roller-ball assembly having a retention cap configured to retain a roller-ball in the roller-ball assembly; placing a roller-ball of the roller-ball assembly against the skin of an individual; and moving the roller-ball assembly such that the roller-ball rotates within the roller-ball assembly and delivers oil to the skin of the individual when the assembly is in any orientation.

BRIEF DESCRIPTION OF THE DRAWINGS

The following description can be better understood in light of Figures, in which.

Figure 1A:
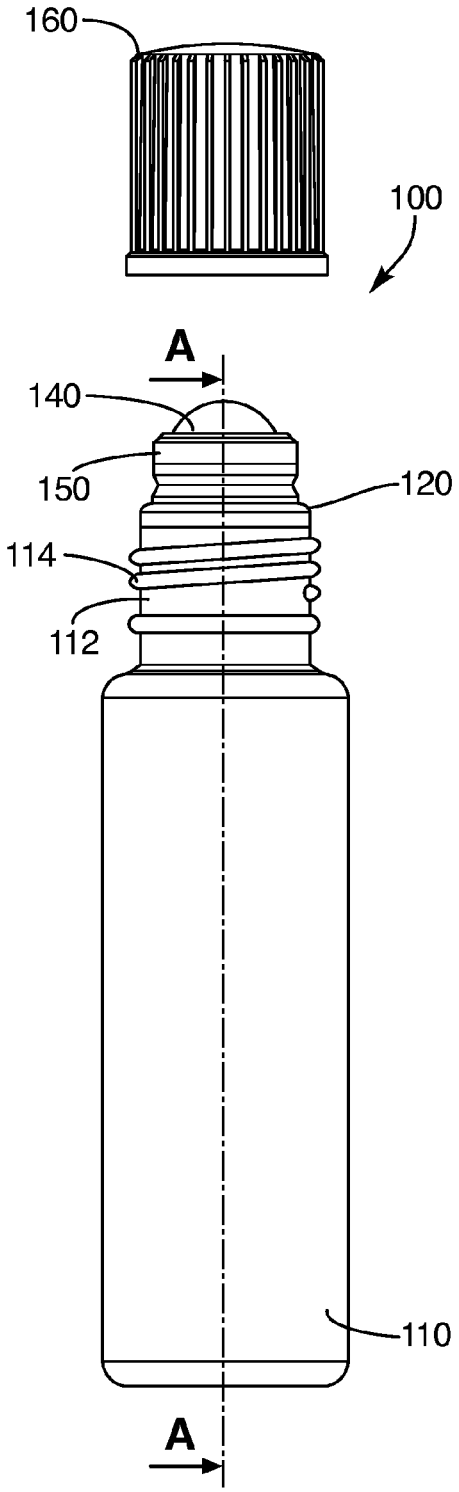
FIG. 1*a* illustrates an exemplary roller-ball topical oil applicator and bottle.

Together with the following description, the Figures demonstrate and explain the principles of roller-ball topical oil applicators with retaining rings and methods for making and using the roller-ball topical oil applicator. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on roller ball applicators used with glass bottles, other types of bottles and containers may be used.

Figure 1B:
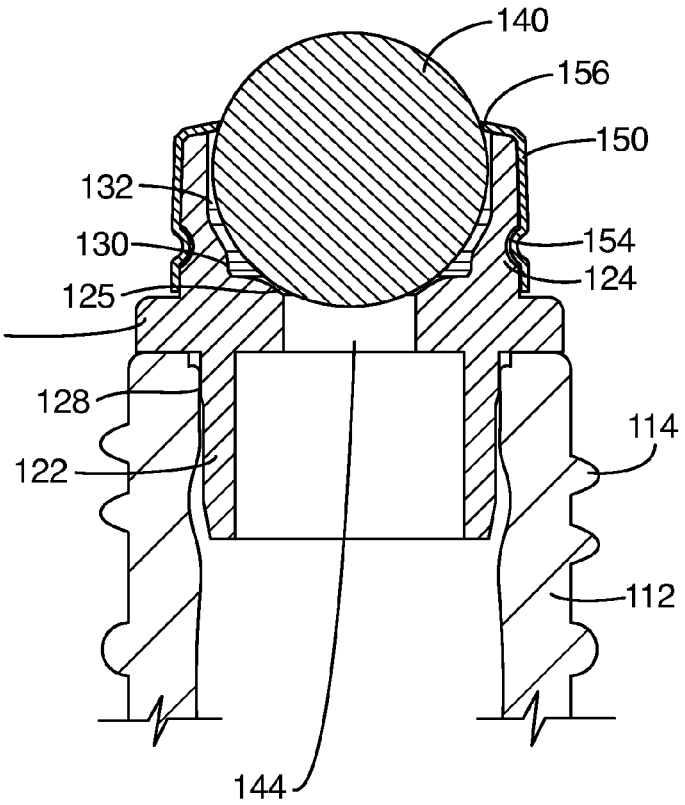
FIG. 1*b* illustrates a cross-sectional view along reference line A-A of FIG. 1 for a portion of the exemplary roller-ball topical oil applicator and bottle of FIG. 1*a;*

FIGS. 1*a*-1*b* illustrate roller-ball topical oil applicator 100, which may be used for storing and applying topical oils, such as essential oils to the skin of an individual or other creature. Applicator 100 may include bottle 110, applicator body 120 with retaining ring 150, roller-ball 140, and cap 160. Bottle 110 may be formed of glass or other suitable container for transporting and containing topical oils such as essential oils, particularly essential oils that tend to act as solvents for plastics. Bottle 110 may include neck 112 and threads 114 on neck 112 to accommodate applicator body 120 and cap 160. In some embodiments, neck insert 122 of applicator body 120 may be of a complimentary size to the internal dimensions of neck 112 to provide an appropriate fitment between bottle 110 and applicator body 120 for a tight fit without leakage.

Neck insert 122 may include retention features 128 to provide increased fit with neck 112 of bottle 110, to prevent oils from seeping out of bottle 110 between neck 112 and neck insert 122. Retention features 128 may be rings, fins, or other features that function to create a seal between applicator body 120 and neck 112. Neck insert 122 may be formed of a pliable or material having elastic properties in order to properly seal when used with a bottle 110 or other container made from glass, since glass is very inelastic. In order to achieve a tight fit between neck insert 122 and bottle 110, one or the other may be formed of a material having elastic properties to allow for neck insert 122 and bottle 110 to conform to each other (within a tolerance range) to fit tightly and form a seal.

Applicator body 120 may be formed from an oil resistant plastic or other suitable material such as chemically resistant polypropylene, ultem, other homopolymers, etc., or other suitable materials, including materials with oil resistant coatings. Applicator body 120 may include neck insert 122, sized appropriately to interface with bottle 110, or other suitable container. Applicator body 120 may also include groove 124 for holding and working in conjunction with retaining ring 150 to hold roller-ball 140 in place in order to apply a desired amount of topical oil.

Retaining ring 150 may include ball retainer lip 156, defining a hole in the top of retaining ring 150 through which a portion of roller-ball 140 may extend. Retainer lip 156 may have an annular diameter dimension smaller than the diameter of roller-ball 140 to secure roller-ball 140 in place without allowing roller-ball 140 to pass through the top of retaining ring 150. Retaining ring 150 may also include indent 154 to cooperate with grove 124 of applicator body 120 to hold retaining ring 150 in place on applicator body 120, thereby holding roller-ball 140 in place. In some embodiments, roller-ball 140 may be held in place with a portion of applicator body 120 with retaining ring 150 securing roller-ball 140 in applicator body 120, such that the materials of applicator body 120 may not relax beyond the dimensions of retaining ring 150.

Retaining ring 150 may be formed of any suitable material to resist relaxation of applicator body 120 if essential oils penetrate the material of applicator body 120, thereby keeping roller-ball 140 in place. Such materials may include metals, such as aluminum, steel, copper, brass, titanium, or any suitable alloy from these or other metals. Such materials may also include ceramics, carbon fiber, or any other suitable material. In some embodiments retaining ring 150 may be coated or treated to resist corrosion, including, for example, anodizing, Teflon coating, enamel, etc.

Figure 2:
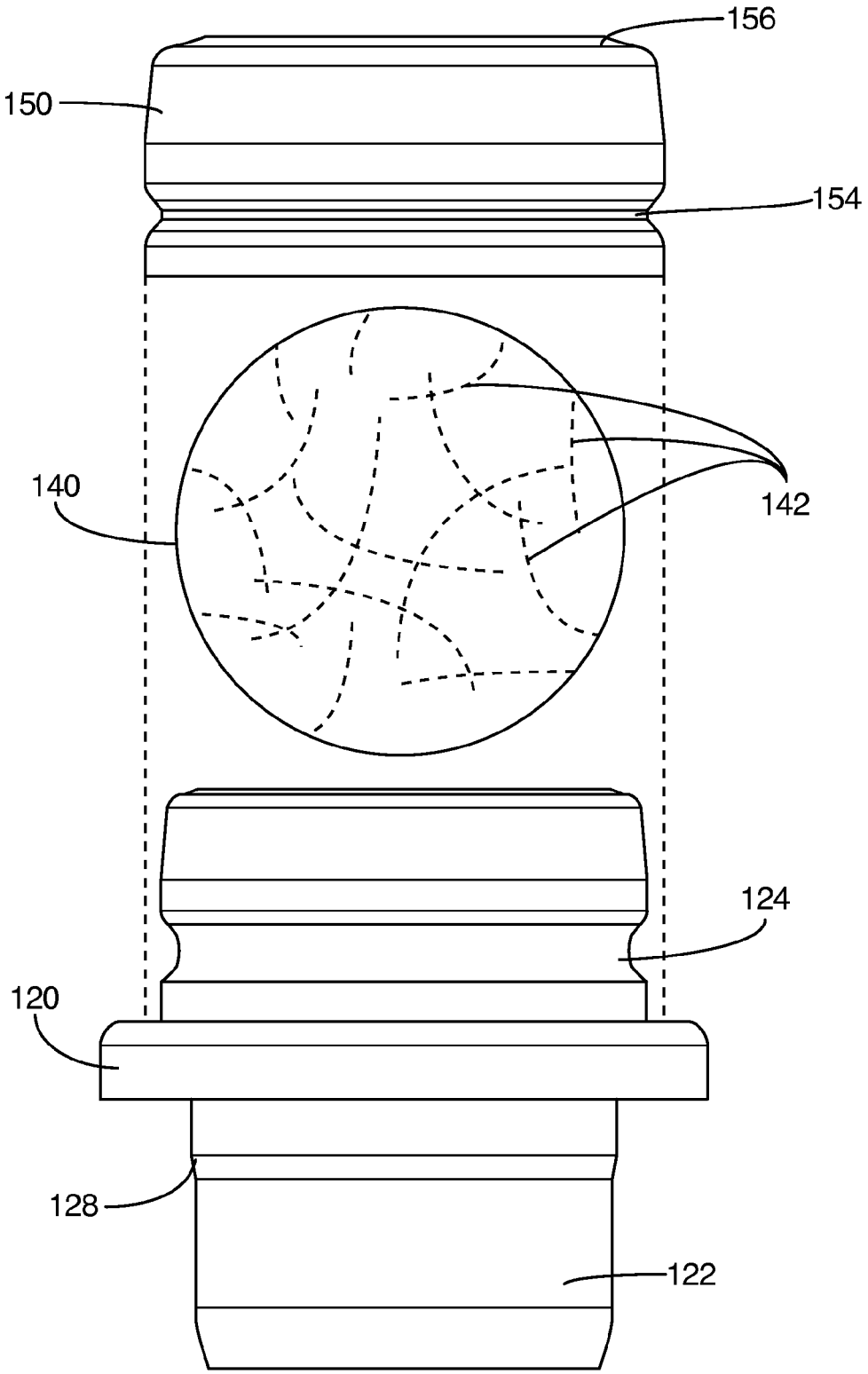
FIG. 2 illustrates an exploded view of exemplary roller-ball topical oil applicator with retention cap.
Figure 3:
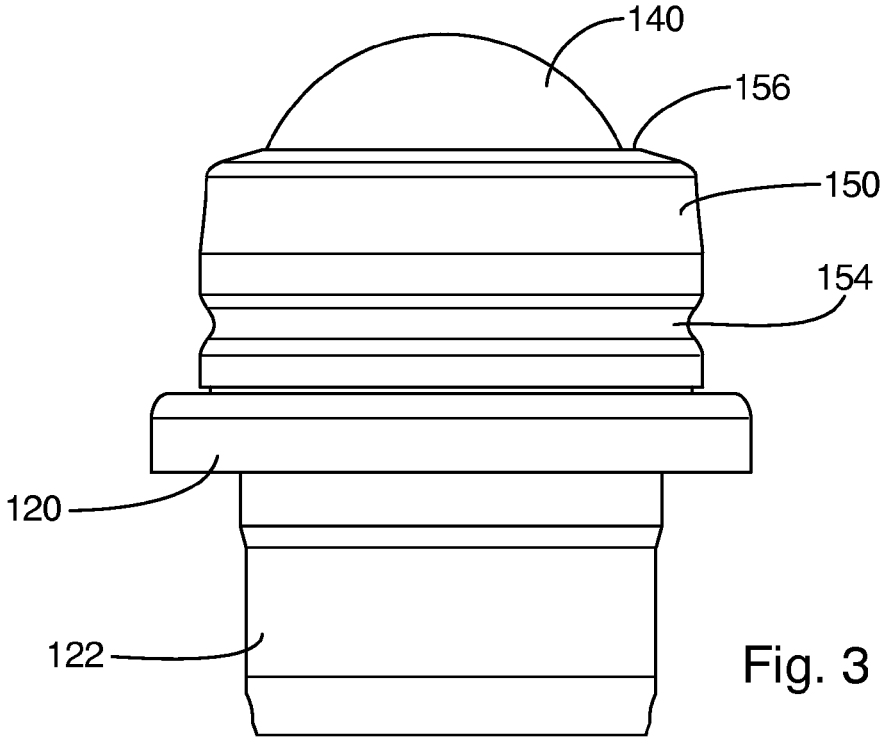
FIG. 3 illustrates an exemplary roller-ball assembly.
Figure 4:
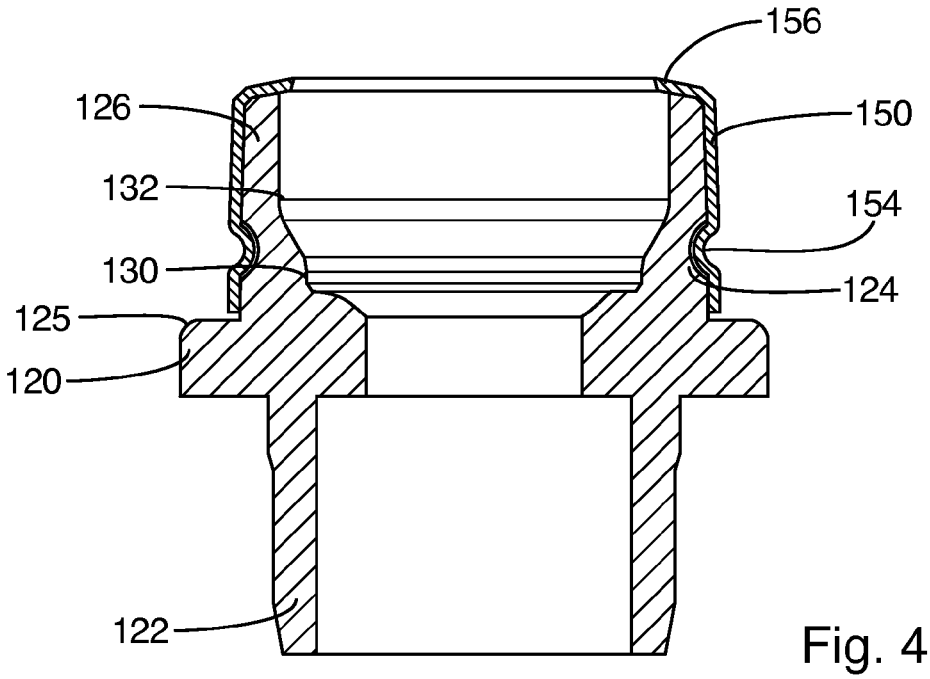
FIG. 4 illustrates a cross-sectional view of an exemplary roller-ball assembly without the roller-ball for illustrative purposes.

As best shown in FIGS. 2-4, roller-ball 140 may be placed in applicator body 120 and then retaining ring 150 may be placed onto applicator body 120. By pressing retaining ring 150 over the upper portion of applicator body 120, indent 154 of retaining ring 150 may snap into place in groove 124 at an appropriate depth to hold roller ball 140 in place, while also providing appropriate spacing to allow a desired flow of essential oils to be applied with roller-ball topical oil applicator 100. As such, at least one of applicator body 120 and retaining ring 150 may be formed of a material that allows for elastic deformation to permit retaining ring 150 to be fitted over applicator body 120 as described and illustrated.

Essential oils such as citrus oils, frankincense, oils high in monoterpenes or blends of such oils mixed with other solvents, tend to affect plastics in an aggressive manner. Retaining ring 150 fitted over applicator body 120 may allow applicator body 120 to be formed of a plastic material that is suitable for use in an inelastic glass bottle to form an appropriate fit without losing roller-ball 140 due to aggressive essential oils. Similarly, roller-ball 140 may be formed of any suitable material sufficient to maintain a desired fit and alignment with applicator body 120 to provide a desired amount of oil at each application. For example, roller-ball 140 may be formed of steel, aluminum, ceramic, or any other suitable material.

Applicator body 120 may include an annular well 130, as illustrated in FIG. 3, that holds topical oil for delivery to an individual using applicator 100. Well 130 may be replenished by tipping applicator 100 with roller-ball 140 downward, which then pulls roller-ball 140 into contact with retainer lip 156, preventing the topical oil from flowing out, but allowing the oil to flow into space 132 and well 130. Space 132 may be about 0.182 mm wide between the side of applicator body 120 and roller-ball 140, extending form retainer lip 156 to lower seat 125. When applicator 100 is in an upright position, roller-ball 140 may be in contact with lower seat 125 by gravity pulling down on roller-ball 140 against lower seat 125.

Similarly, when applicator 100 is in an overturned position, roller-ball 140 may be in contact with retainer lip 156, preventing the topical oil from flowing out freely. In some embodiments, oil may be dispensed by tapping applicator 100 against the skin of an individual, thereby moving roller-ball 140 upward and allowing oil to exit onto the skin. When overturned, each tap may allow for more oil to flow into the spaces around roller-ball 140. In some embodiments, a biasing member such as a spring (not shown) may be used to push roller-ball 140 against retainer lip such that roller-ball 140 may dispense oil only when pressed to push roller-ball 140 away from retainer lip 156.

When roller-ball 140 is rotated, an amount of the oil may coat the exterior surface of roller-ball 140 and may then be deposited on the skin of an individual using applicator 100 by rolling roller-ball 140 along their skin. Applicator 100 may work in any orientation to deliver oil to the skin of a user in part because well 130 holds oils to coat roller-ball 140 even when applicator 100 is oriented such that oil is not contacting roller ball 140 through channel 144. Typically, a single topical oil application will deliver between about 0.05 and 1 ml in a single application. In some embodiments, a single application may be about 0.3 ml. To apply in an overturned position, a pressure may be applied to roller-ball 140 as it contacts against the skin to which topical oils are to be applied, which may allow oils to flow from between retainer lip 156 and roller-ball 140. To apply in an upright position, roller-ball 140 may collect oils from well 130 and space 132, and since roller-ball 140 is generally positioned against lower seat 125, the oil is able to be delivered without being scraped off by retainer lip 156.

Because roller-ball 140 may have some play between contact with lower seat 125 in one position and contact with retainer lip 156 in the other, oil may be retained in well 130 and space 132 to deliver to a user in any orientation, even after applicator has been in an upright position for some time. For example, when cap 160 is in position, an internal cap ring may press down on roller-ball 140, which in turn presses down against lower seat 125, effectively trapping any oils remaining in well 130 and space 132 for delivery when cap 160 is removed as desired. Similarly, such an arrangement may significantly reduce vapor losses due to evaporation that are sometimes common with essential oils.

Applicator 100 may be formed in any size suitable for delivery of topical oils, such as essential oils. The various components of applicator 100 may be sized accordingly, however, space 132 and well 130 may be designed and spaced to provide between about 0.05 and 1 ml in volume for a desired application amount. In other embodiments, a larger or smaller amount may be desired for each application.

In some embodiments, cap 160 may be formed to connect directly to applicator body 120, and applicator body 120 may be formed to connect to threads 114 of bottle 110. Cap 160 may include interior threads that correspond with threads 114 of bottle 110, or with threads that may be included on applicator body 120. In other embodiments, cap 160 may be a snap-fit, or other type of connection, such as hinged, etc.

In some embodiments, roller-ball 140 may include surface features 142 that facilitate collecting oils onto roller-ball 140 when being used. In some embodiments, surface features 142 may be various patterns or designs, such as with a company logo, geometric pattern, or other desired aesthetic feature that also serves to carry oil. Surface features 142 may be formed in or on the surface of roller-ball 140 through any method, such as etching, cutting, grinding, micro-welding, casting, stamping, etc.

Figure 5:
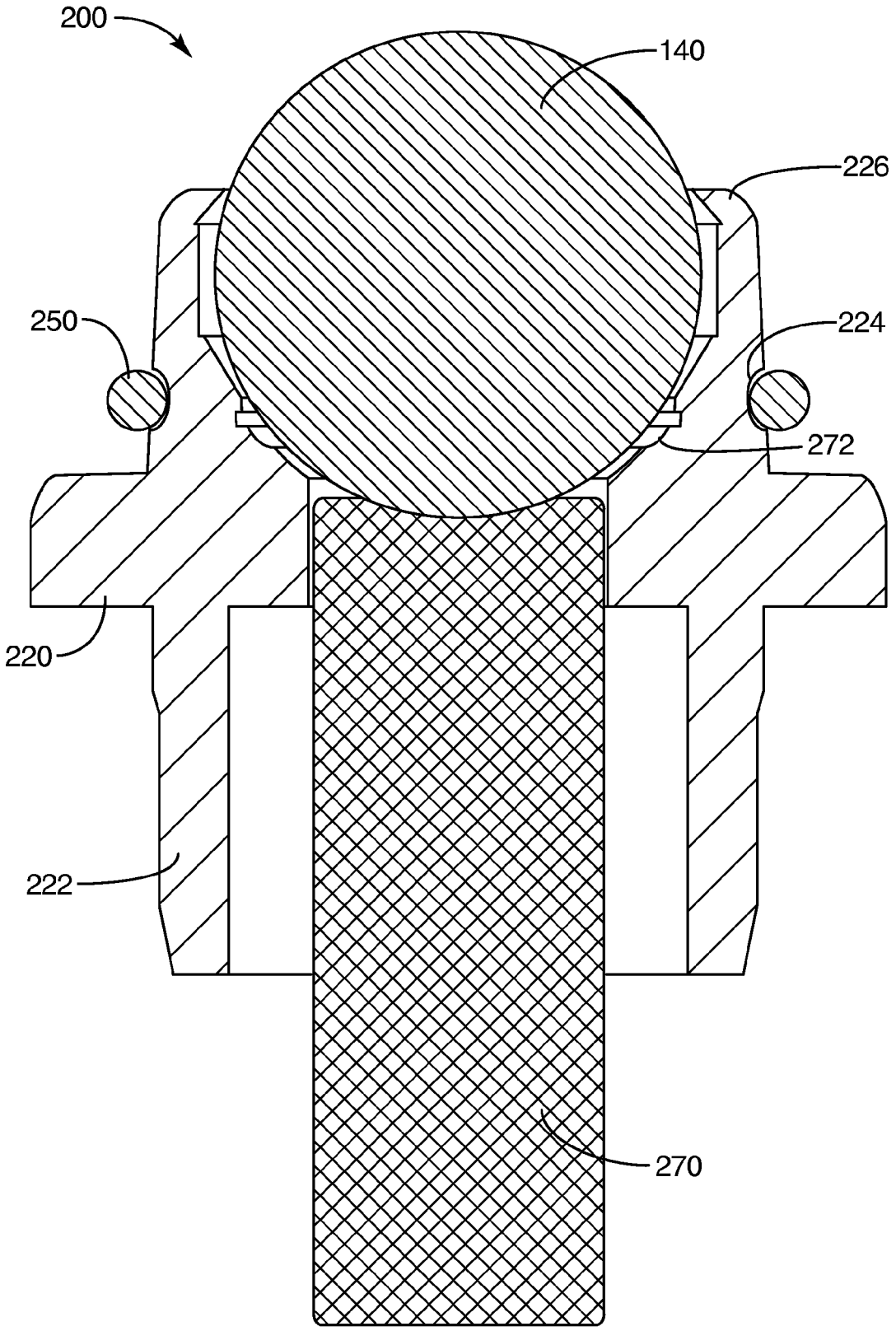
FIG. 5 illustrates a cross-sectional view of an exemplary roller-ball assembly.

In some embodiments, such as the embodiment shown in FIG. 5, applicator insert 200 may include applicator body 220, retaining ring 250, and in some embodiments, may include wick 270 and/or absorbent ring 272. Retaining ring 250 may be a simple ring formed similarly to retaining ring 150 of materials that may prevent applicator body 220 and retaining lip 226 from relaxing to allow roller-ball 140 to fall out. Applicator body 220 may include groove 224, similar to groove 124 of the embodiments described above, that holds retaining ring 250 in place. In such embodiments, retaining lip 226 may be formed to hold roller-ball 140 in place. Roller-ball 140 may be inserted by pushing through the opening of retaining lip 226 which may elastically stretch to allow roller-ball 140 to be put in place and returning to its dimensions to hold roller-ball 140 in applicator body 220.

In some embodiments, wick 270 may be included to draw oils into contact with roller-ball 140 to replenish oils for delivery with roller-ball 140. Similarly, absorbent ring 272 may be placed to absorb oils and then distribute the oils to roller-ball 140. Wick 270 and absorbent ring 272 may be formed of any suitable materials to allow delivery of essential oils. Similarly, in some embodiments, wick 270 may be replaced with a small-diameter tube that functions using capillary action to draw oil up to replenish well 130, absorbent ring 272, and/or roller-ball 140.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

The invention claimed is:

1. An applicator for applying topical oils to an individual, the applicator comprising:

an applicator body comprising a roller ball cavity and a first material;

a roller ball disposed within the roller ball cavity of the applicator body such that at least half of the roller ball is within the roller ball cavity of the applicator body;

a retention ring coupled to and disposed about an outer portion of the applicator body, the retention ring being entirely external to the roller ball cavity, the retention ring being configured to prevent the applicator body from expanding outwardly, the retention ring comprising a second material, the second material being different from the first material; and a retainer lip of the retention ring, the retainer lip having an opening with an annular diameter dimension smaller than the diameter of the roller ball to secure the roller ball within the applicator body.

2. The applicator of claim 1, wherein the roller ball is disposed within a cavity of the applicator body, wherein the retainer lip covers a portion of an opening of the cavity.

3. The applicator of claim 2, wherein the cavity includes an annular well formed in an inner surface of the cavity, the annular well having a volume between 0.05 and 1 mL.

4. The applicator of claim 1, wherein the applicator body includes a groove, and wherein the retention ring includes an indent that cooperates with the groove to hold the retention ring in place.

5. The applicator of claim 1, wherein the second material is metal.

6. The applicator of claim 5, wherein the first material is an oil-resistant plastic or a homopolymer.

7. The applicator of claim 1, wherein the second material is a ceramic.

8. The applicator of claim 1, wherein the applicator body includes a groove, and wherein the retention ring is disposed within the groove.

9. The applicator of claim 1, further comprising a container configured to hold topical oil; and a cap configured to be removably attached to the container and to seal the topical oil container when the cap is securely attached to the container.

10. The applicator of claim 9, wherein the topical oil container contains an essential oil.

11. The applicator of claim 10, wherein the essential oil comprises a citrus essential oil.

12. The applicator of claim 9, wherein the cap is configured to press down on the roller ball to seal the topical oil container when the cap is attached to the container.

13. The applicator of claim 9, wherein the container is formed from glass.

14. An applicator for applying topical oils to an individual, the applicator comprising:

an applicator body comprising a first material;

a roller ball disposed within the applicator body such that at least half of the roller ball is within the applicator body;

a retention ring coupled to and disposed about an outer portion of the applicator body the retention ring being entirely external to the applicator body, the retention ring being configured to prevent the applicator body from expanding outwardly, the retention ring comprising a second material, the second material being different from the first material; and a retainer lip of the retention ring, the retainer lip having an opening with an annular diameter dimension smaller than the diameter of the roller ball to secure the roller ball within the applicator body.

15. The applicator of claim 14, wherein the roller ball is disposed within a cavity of the applicator body, wherein the retainer lip covers a portion of an opening of the cavity.

16. The applicator of claim 15, wherein the second material is metal.

17. The applicator of claim 16, wherein the first material is an oil-resistant plastic or a homopolymer.

18. An applicator for applying topical oils to an individual, the applicator comprising:

an applicator body comprising a first material;

a roller ball disposed within the applicator body such that at least half of the roller ball is within the applicator body;

a retention ring coupled to and disposed about an outer portion of the applicator body, the retention ring being configured to prevent the applicator body from expanding outwardly, the retention ring comprising a second material, the second material being different from the first material; and a retainer lip of the applicator body, the retainer lip having an opening with an annular diameter dimension smaller than the diameter of the roller ball to secure the roller ball within the applicator body, wherein the retention ring is a simple ring.

19. The applicator of claim 18, wherein the roller ball is disposed within a cavity of the applicator body, wherein the retainer lip covers a portion of an opening of the cavity.

20. The applicator of claim 19, wherein the second material is metal.

21. The applicator of claim 18, further comprising:

a container coupled to the applicator body, the container being configured to hold a topical oil; and a cap removably attached to the container and configured to press down on the roller ball when the cap is attached to the container to seal the topical oil container.

* * * * *